US006087908A

United States Patent [19]

Haller et al.

[11] Patent Number: 6,087,908

[45] Date of Patent: Jul. 11, 2000

[54] PLANAR ORTHO-MODE TRANSDUCER

[75] Inventors: Nicolas Haller, Evergreen, Colo.; Scott J. Cook, Garner, N.C.

[73] Assignee: Channel Master LLC, Smithfied, N.C.

[21] Appl. No.: 09/152,134

[22] Filed: Sep. 11, 1998

[51] Int. Cl.[7] ..... H01P 1/161

[52] U.S. Cl. ..... 333/122; 333/135; 333/21 A; 343/756

[58] Field of Search ..... 333/122, 126, 333/135, 21 A; 343/756

[56] References Cited

U.S. PATENT DOCUMENTS

| | | | |
|---|---|---|---|
| 3,435,380 | 3/1969 | Billon et al. | 333/21 A X |
| 3,731,236 | 5/1973 | Di Tullio et al. | 333/21 A X |
| 5,384,557 | 1/1995 | Yoshida et al. | 333/21 A |

FOREIGN PATENT DOCUMENTS

| | | | |
|---|---|---|---|
| 2459045 | 4/1976 | Germany | 333/21 A |

*Primary Examiner*—Justin P. Bettendorf
*Attorney, Agent, or Firm*—Darby & Darby

[57] ABSTRACT

An ortho-mode transducer is disclosed having a common waveguide and two orthogonal port waveguides, each of which is also orthogonal to the common waveguide. Each port waveguide is coupled to the common waveguide with a coupling aperture which will pass signals having a particular polarity and cut off orthogonally polarized signals. The common waveguide is terminated in a shorting plane about one-quarter of the excepted signal wavelength from the vertical midpoint of the port waveguides. The short directs energy from the common waveguide into the port waveguides and directs energy from the port waveguides into the common waveguide.

18 Claims, 5 Drawing Sheets

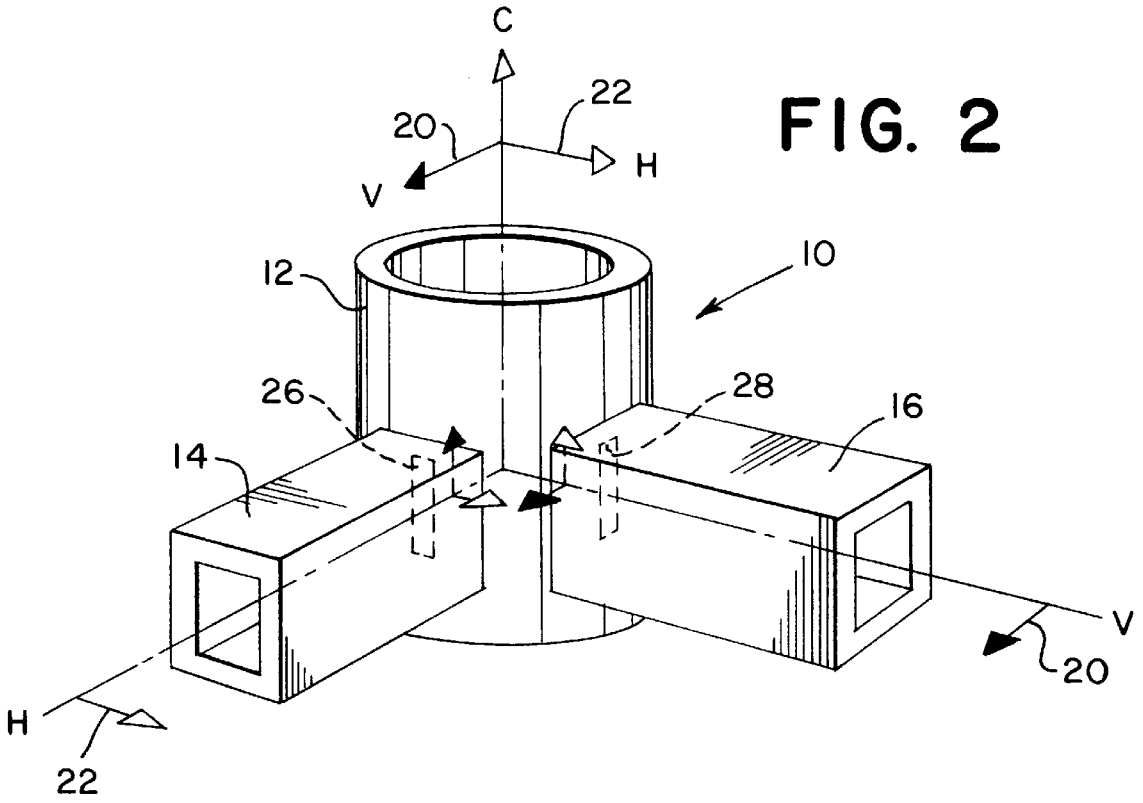
FIG. 2
FIG. 3a
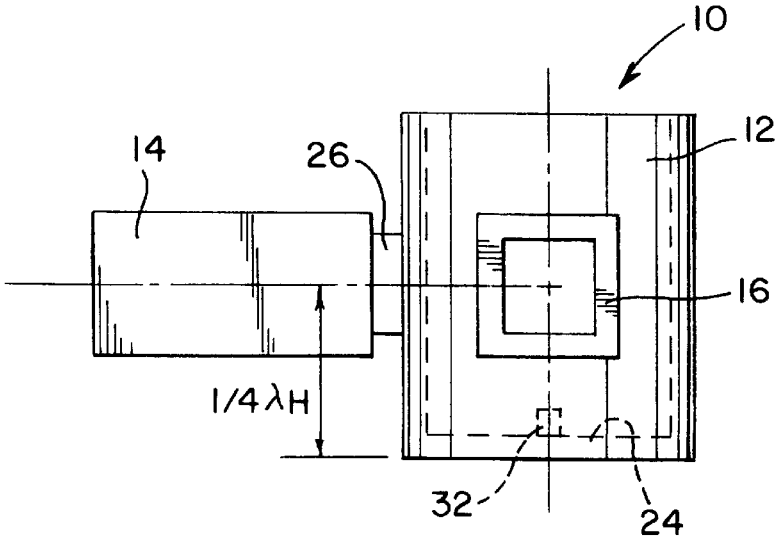

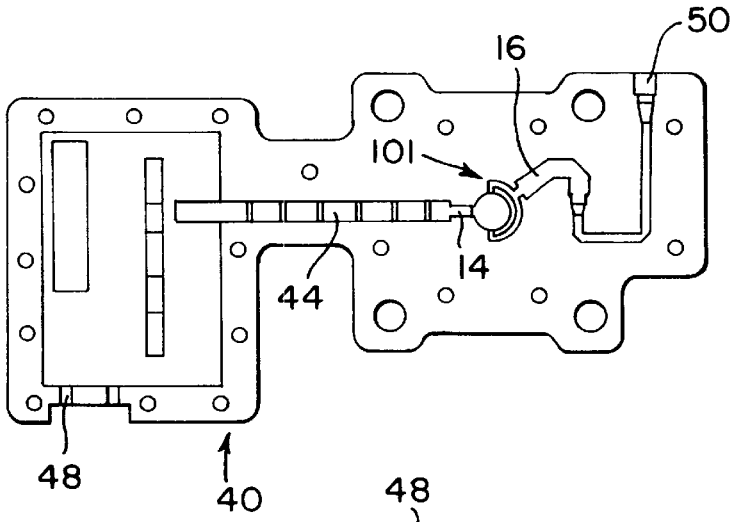
FIG. 5a
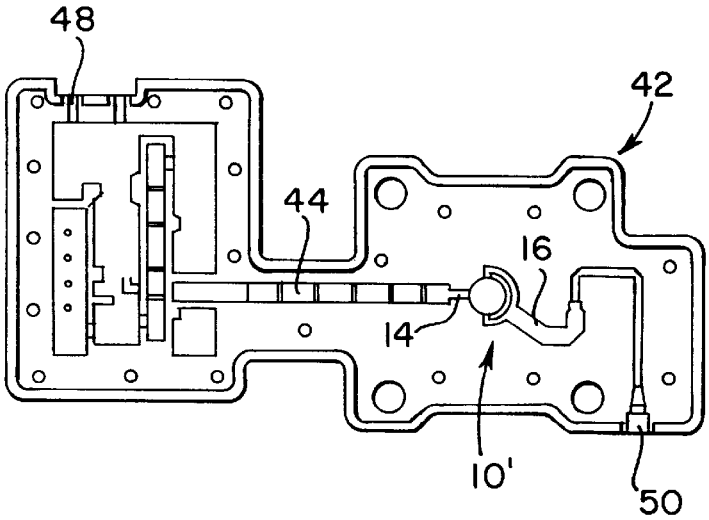
FIG. 5b
FIG. 5c
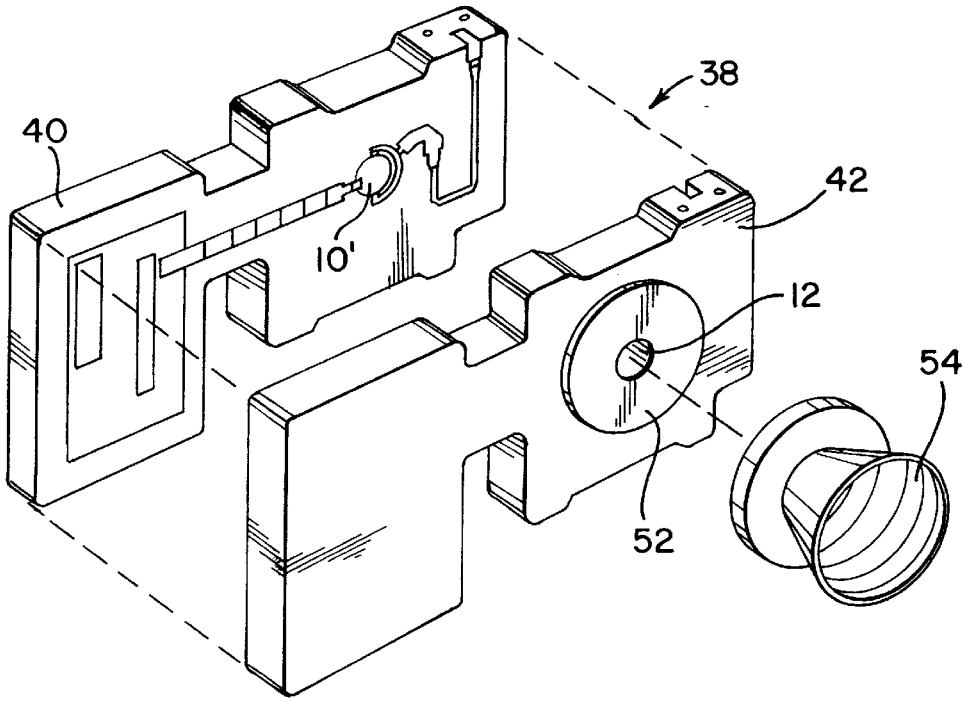

PLANAR ORTHO-MODE TRANSDUCER

TECHNICAL FIELD

This invention is related to a waveguide device which supports two orthogonal signal modes. More specifically, this invention is related to an ortho-mode transducer in which the two orthogonal ports are realized in the same plane.

BACKGROUND OF THE INVENTION

An ortho-mode transducer ("OMT") is a three-port waveguide device which supports signals having two orthogonal modes. For purposes of discussion, the two orthogonal signal modes will be designated as H and V linear polarities. A conventional OMT is shown in FIGS. 1A–1G. The common port (port 1) is a circular, square, or similar type of waveguide portion which supports both H and V polarization signals. The through port (port 2) is a waveguide portion aligned with the common port waveguide and which supports only V polarized signals. Port 3, the side port, is a waveguide which splits off from the common and through port waveguides and supports only H polarized signals.

OMTs are often used in reflector antenna systems to separate H and V polarized signals. The combined signal is received, i.e., as focused energy from a parabolic reflector, and applied to the common port of the OMT through a feedhorn. The received V and H polarized signals are separated and output via the through and side ports, respectively. OMTs are also used in applications when the antenna system transmits H polarized signals and receives V polarized signals. For this application, the H polarized output signal is transmitted from a power amplifier module into the through port of the OMT, where it is directed into the common port and output into the feed horn and the reflector. V polarized signals are funneled by the feed horn into the common port of the OMT, where it is directed into the side port and into a receiver module (containing, for example, a filter, amplifier, down converter, etc.). For receive only antenna systems or transmit/receive antenna systems the orthogonal through and side ports can be designed to cover the same, distinctly different or overlapping frequency bands.

Good port to port isolation is critical to applications that transmit from the V port and receive on the H port because the power transmitted from the V port toward a distant satellite or terrestrial hub is very high in comparison to the low power received at the H port. In conventional OMT designs, signal separation and isolation between the through and side ports is achieved by providing a septum or reduction in height in the body of the OMT near the junction between the common and through waveguide portions. The septum or height reduction redirects H polarity signals from the common port into the side port, while allowing V polarity signals from the common port to continue into the through port. The arrangement also works in reverse, channeling both V polarity signals entering the through port and H polarity signals entering the side port into the common port. This mechanism, together with the orthogonal orientation of the through and side ports, provides relatively good isolation between through and side ports. In other words it allows only a small amount of the energy of H polarity signals to enter the through port and very little V polarity signal energy to enter the side port.

Although conventional OMT designs offer good port to port isolation and functionality, the structure is asymmetric with respect to the common port because the through, or V port is aligned with the common port, while the side, or H port is orthogonal to the common port. This asymmetry can degrade port to port isolation. It can also result in degraded cross polarity (x-pol) rejection, i.e., the V port's rejection of the H polarity coming from the common port, and the H port's rejection of V polarity coming from the common port.

Furthermore, because all three ports lie in the same plane, and because the V port is axially aligned with the common port, the feed antenna connected to the common port will lie along the same axis as any transmit or receive elements connected to the V port. This results in a bulky assembly which is unsuitable for many applications.

Accordingly, it is an object of the invention to provide an OMT wherein both the H and V ports are in the same plane and are orthogonal to the common port.

It is a further object of the invention to provide an OMT with improved cross polarity rejection.

Yet another object of the invention is to provide an OMT which may be inexpensively fabricated as two planar elements joined together, which elements contain the necessary filters, waveguides, etc. for integrating the OMT and with a transmit package and/or a receive package.

SUMMARY OF THE INVENTION

According to the invention, a planar OMT is provided in which the H and V ports both lie in a plane which is substantially orthogonal to the common port. The common waveguide is terminated in an appropriately placed short which forces the energy into the H and V ports, as opposed to the conventional design which directs the H and V mode signals by using a reduced height wave guide or a septum. If the frequency bands of the two polarities are the same, the short is positioned approximately ¼ wavelength away from the center of the H and V ports. If the frequency bands of the two polarities are significantly different, one or more ridges may be placed in the end of the shorting wall lined up with the higher frequency to provide more optimum distance for matching.

According to a further aspect of the invention, the isolation and cross polarity rejection between the H and V ports is increased by connecting the H port to the common port with two sub-ports which enter the common port at opposite sides and, preferably, substantially perpendicular to and in the same plane as the V ort. Because there is a 180° phase difference in the signals at the two sub-ports, the sub-ports are arranged so that distance between one sub-port and the H port is ½ wavelength longer than the distance from the other sub-port to the H port in order to properly combine them.

In yet a further aspect of the invention, the OMT is fabricated in two pieces (top and bottom) which are fastened together along a plane common to the H and V ports. All of the necessary filters, waveguides, and transmit/receive microwave housing can be formed in these two OMT elements, greatly reducing the number of housings and connections, which in turn reduces cost and improves performance. In addition, because of the orthogonal relationship between the ports, when H and V signals are received and extracted by the new OMT, the output polarities of the signals are aligned, thus making it easier to integrate the OMT with downstream elements. Similarly, when transmitting orthogonal H and V signals, the two signals may initially be presented to the OMT with the same polarity. The orthogonal relationship between the ports will create a 90 degree difference in the polarity of the signals as they are fed into the common port to provide orthogonally polarized signal components.

BRIEF DESCRIPTION OF THE DRAWINGS

The foregoing and other features of the present invention will be more readily apparent from the following detailed description and drawings of illustrative embodiments of the invention in which:

FIG. 2 is a perspective view of a planar OMT according to the invention;

FIGS. 3*a* and 3*b* are side and top views, respectively, of the OMT shown in FIG. 2;

FIGS. 5*a* and 5*c* show a transceiver unit including the planar OMT of FIG. 4 fabricated according to a further aspect of the invention.

DETAILED DESCRIPTION OF THE PREFERRED EMBODIMENTS

Figure 1A:
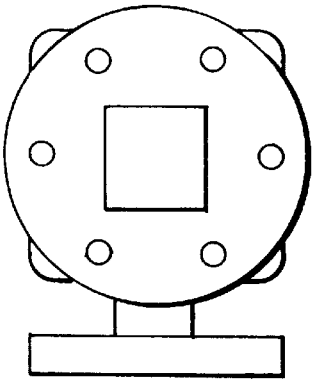
FIG. 1a PRIOR ART
FIGS. 1A–1G shows a conventional OMT design.
Figure 1B:
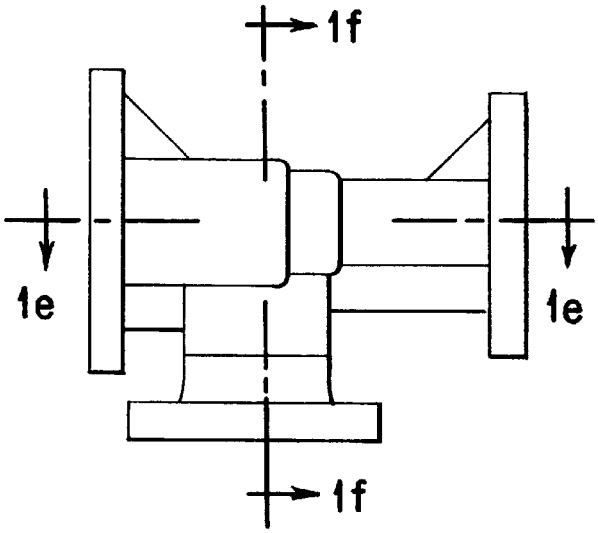
FIG. 1b PRIOR ART
Figure 1C:
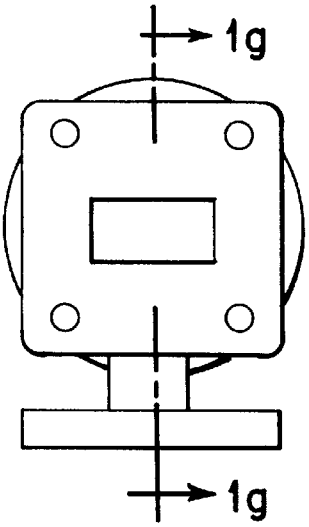
FIG. 1c PRIOR ART
Figure 1D:
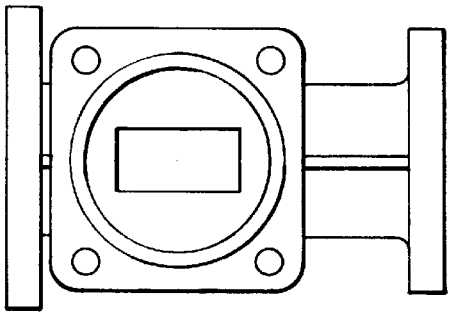
FIG. 1d PRIOR ART
Figure 1E:
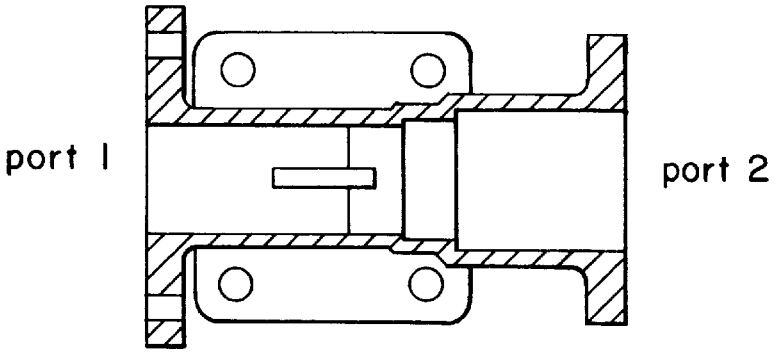
FIG. 1e PRIOR ART
Figure 1F:
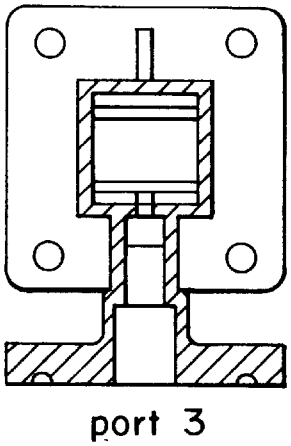
FIG. 1f PRIOR ART
Figure 1G:
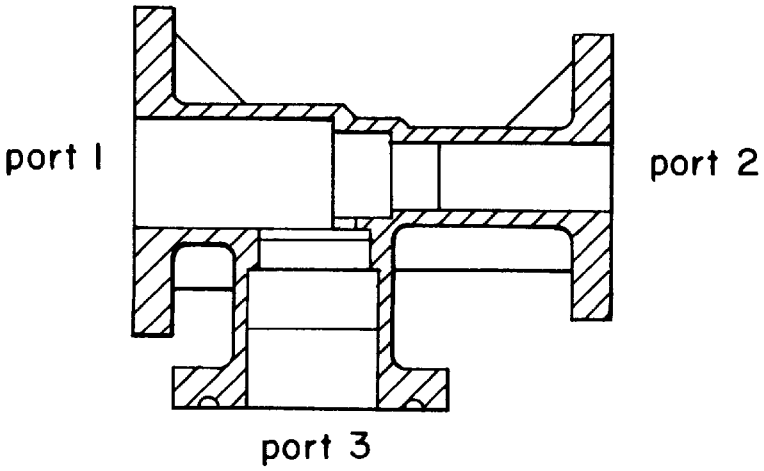
FIG. 1g PRIOR ART
Figure 3B:
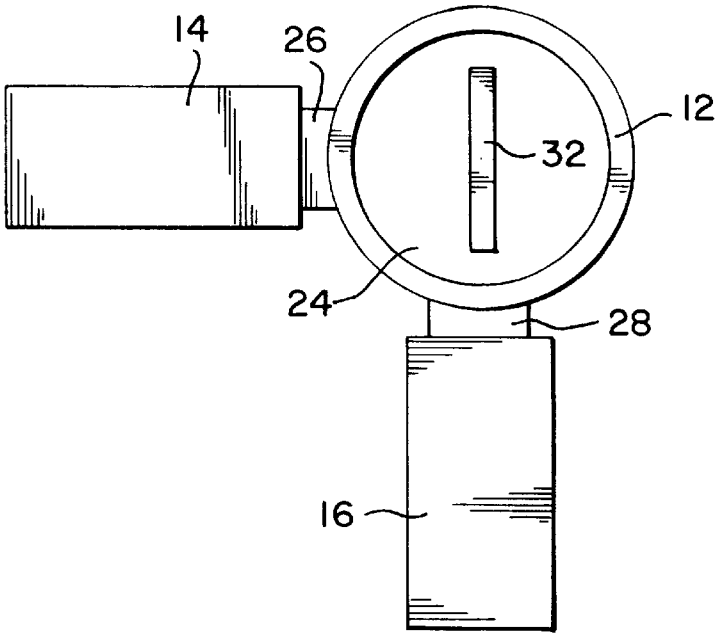

Turning to FIGS. 2, 3*a*, and 3*b*, there is shown an OMT 10 according to the present invention. OMT 10 has a common port 12, and two side ports 14, 16. For purposes of discussion side port 14 will be referred to as the "H port" and side port 16 will be referred to as the "V port." The use of H and V is used here for simplicity and is not intended to limit the polarity of the signals carried by the side ports 14, 16, or to limit the polarizations to only orthogonally polarized signals.

Common port 12 is a waveguide, aligned along the common axis C, which is suitable for carrying at least two differently polarized signals, represented in FIG. 2 as polarity vectors 20, 22. Signal 20 has a first polarization, designated "V", and is centered about frequency f(v) with wavelength λ(v). Signal 22 has a second polarization, designated "H", and is centered about frequency f(h) with wavelength λ(h). Although a circular waveguide structure is shown, those of skill in the art will recognize that other configurations, such as rectangular or oval, may also be used, particularly if the frequency bands of the two polarities of signals to be carried are not the same, i.e., f(v) and f(h) are different or the expected bandwidth of the V and H signals 20, 22 is not the same.

The H port 14 is a waveguide structure, here shown as a rectangular waveguide, which is coupled to the common port 12 by a suitable coupling aperture 26. Port 14 is aligned along the H axis. Aperture 26 is configured to pass signals of a given polarity, such as a signal 22, when the OMT 10 is properly aligned with the plane of polarization of the signal. In the embodiment shown in FIG. 2, the H axis is perpendicular to plane of polarization for the H signal 22. The plane of polarization may represent either the magnetic or electric field, depending on the type of coupling aperture utilized. Designs for coupling apertures of this type are well known to those skilled in the art. Waveguide port 14 is configured to carry such a polarized signal.

The V port 16 is a waveguide structure, here shown as a rectangular waveguide, which is coupled to the common port 12 by a suitable coupling aperture 28. Port 16 is aligned along the V axis and coupled to the common port 12 at a predetermined angle relative to the H axis. The specific angle is determined by the relative difference in polarity orientation between the two signal components 20, 22. When the OMT 10 is properly aligned, the V axis is perpendicular to the plane of polarization for the V signal 20.

In the preferred embodiment, the two signal components 20, 22 are orthogonally polarized signals and port 16 is coupled to the common port 12 at substantially a 90 degree angle relative to port 14, such as shown in the figures. Aperture 28 is configured to pass signals of a given polarity, such as signal 20, which is horizontally polarized, and the waveguide of port 16 is configured to carry such a polarized signal.

The common port 12 terminates in a short 24, such as a conducting wall, which forces energy carried by the common port 12 into the H and V ports 14, 16. To achieve this result, the short 24 is positioned approximately an odd number of quarter wavelengths from the vertical mid-point or center 30 of the V and H ports 14, 16 (when the frequency of the H and V components are substantially the same). In other words, the short position is approximately a distance of $\lambda*(2n+1)/4$ from the vertical mid-point, where n is an integer greater than or equal to zero. In the preferred embodiment, the short is positioned approximately ¼ wavelength from the center 30 to maximize the usable bandwidth of the device.

If the frequency bands of the two polarity signals 20, 22 are significantly different. The shorting wall 24 is preferably positioned ¼ wavelength from the center of the side port which will carry the lower frequency and longer wavelength signal. For example, if f(v) is significantly lower than f(h), the short 24 is placed approximately ¼ λ(v) from the center of V port 16. To provide an appropriate shorting point for the higher frequency side port, here H port 14, one or more ridges 32 which are lined up with the higher frequency polarity port 14 can be placed in the common port 12 to provide a short which is visible only for the H polarity signal. The appropriate dimensions and number of ridges to achieve a "virtual" shorting point at ¼ λ(h) from the center of H port 14 depend on the geometry and operating frequency of the OMT 10 and techniques for selecting the appropriate waveguide impedance divider characteristics are known to those of skill in the art.

The OMT 10 may be used to separate two orthogonally polarized input signals 20, 22 having V and H polarization. Signals 20, 22 are received, i.e., through a horn feed, and channeled into the common port 12. The signal components are reflected by the terminating short and directed towards the sides of the common port waveguide 22. Different polarity signal components may be extracted by connecting the side ports to the common port 12 at appropriately positioned aperture locations.

For example, as illustratively shown with the V and H signal vectors of FIG. 2, the relative polarity of the signal components as they are directed outwards from the axis of the common port and into the side ports 14, 16 is dependent on the position along the axis at which the signal is measured. As shown, the coupling aperture 26 is configured such that the V polarity signal 20 is cut off and therefore does not see the H port 14. The coupling aperture 28 is aligned such that it accepts V polarity signals 20. Further, the V port 16 is configured to accept the V polarity signal 20 and pass it through to components downstream from the V port 16. Similarly, the coupling aperture 28 is configured to cut off the horizontal signal component 22, whereas the aperture 26 accepts and passes the H polarity signal 22 to the horizontal port 14.

Although the OMT 10 has been discussed with respect to receiving differently polarized signals, the device may also be used in reverse. Signals having aligned polarities which are input to the H and V ports 14, 16 are transmitted through the OMT 10 to provide orthogonal signal components which output from the common port 12. OMT 10 may also be used as part of a transducer, where, for example, V polarity signals are received and H polarity signals are transmitted.

The OMT 10 illustrated in the figures is an H-plane OMT in that the ports and 14, 16 and apertures 26, 28 have their longer wall parallel to the common waveguide 12 (i.e., the ports are tall and skinny). However, OMT 10 may also be formed in an E-plane configuration, where the long wall is perpendicular to the common mode waveguide 12 (i.e., the ports are short and wide). Other configurations may also be used, provided that the apertures admit the proper polarity signals and the ports carry those signals.

Figure 4:
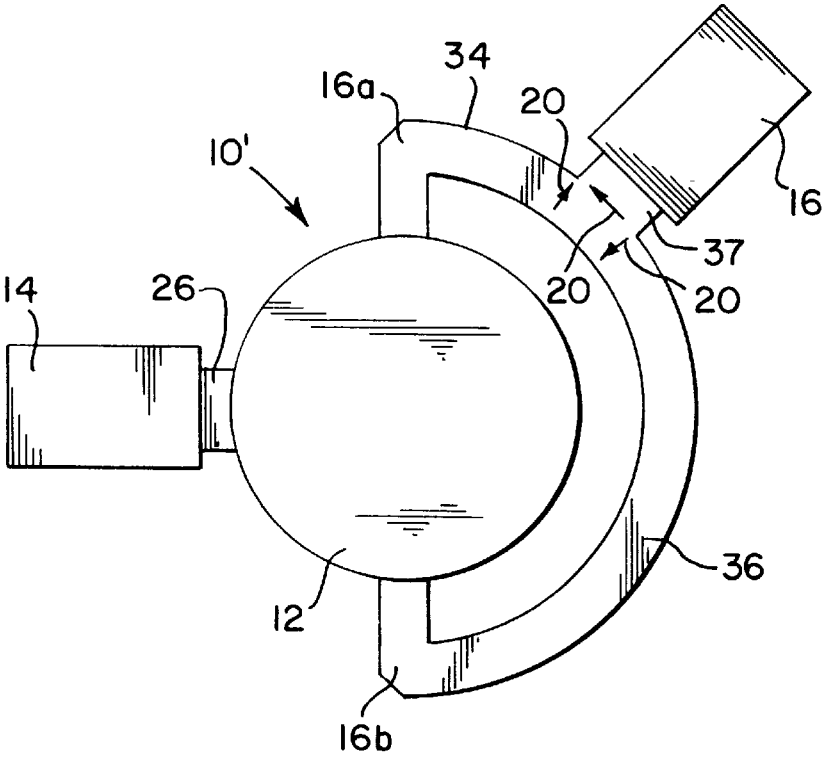
FIG. 4 is a top view of a planar OMT according to a second aspect of the invention.

According to a further aspect of the invention, shown in FIG. 4, the cross polarity rejection of the OMT 10' is improved by increasing the symmetry of at least one of the side ports 14, 16. This is accomplished by replacing a single port 16 with two sub-ports 16*a* and 16*b*, which are coupled to the common mode waveguide 12 at opposing points substantially 180 degrees from each other. The coupling is achieved through suitably configured coupling apertures which pass signals having the desired polarization, here the V polarization signal 20, as discussed above.

These two ports (16*a* and 16*b*) are in the same plane and are combined in the same plane with intermediate waveguides 34 and 36 coupled to single port 16 by a waveguide impedance divider 37. As illustrated, signals entering waveguides 34, 37 from waveguide 16 at the impedance divider are 180 degrees out of phase. To account for this phase difference, the length of waveguide 36 from port 16*b* to the divider 37 is an odd number of one half wavelengths longer, preferably ½ $\lambda(v)$, than the length of waveguide 34 from port 16*a* to the divider 37. Preferably, waveguides 34 and 36 are rectangular and have a length differential which is half the center frequency of the signal component processed by the respective port 16, i.e., $\lambda(v)/2$.

According to a further aspect of the invention, shown in FIG. 5*a*, the OMT 10' (or 10) may be constructed of two generally planar pieces or blocks 40, 42 (top and bottom) that can be fabricated using conventional techniques, such as machining, casting, or both, and then fastened or otherwise assembled together. The two pieces each contain upper and lower portions of the OMT structure components. For example, with reference to FIG. 2, the OMT may be divided into two parts separated along the plane defined by or at least parallel to the H and V axes. A portion of the common and port waveguides is formed into each block 40, 42. All of the necessary filters, waveguides, and transmit/receive microwave housing can be built (machined or cast) into these same two pieces 40, 42. This greatly reduces the number of housings and connections, which in turn reduces cost and improves performance. FIG. 5*a* illustrates a unit 38 which integrates the OMT 10', filters 44, and a transmitter or receiver package 48 into a single package. Also provided is an output port 50 to which a second transmitter or receiver package may be connected. Alternatively, the pieces 40, 42 forming unit 38 may be extended to integrate the second transmitter or receiver in a manner similar to the first 48, to thereby form an integral transceiver unit fabricated from a minimum number of parts.

FIG. 5*b* is an exploded view of the unit 38, further including a feed horn 54 which attaches to the common port 12 of the OMT 10' via a suitable coupler 52. Because the feed horn 54 is perpendicular to the rest of the transceiver structure, a very compact assembly may be produced.

While the invention has been particularly shown and described with reference to preferred embodiments thereof, it will be understood by those skilled in the art that various changes in form and details may be made therein without departing from the spirit and scope of the invention.

What is claimed is:

1. An ortho-mode transducer comprising:

a common waveguide aligned along a central common axis and configured to carry a first polarized signal having a first wavelength and a second polarized signal having a second wavelength, said first and second signals having polarity vectors differing by a predetermined angle, said common waveguide having a shorting point;

a first port waveguide configured to carry said first signal, said first port waveguide being coupled to said common waveguide above said shorting point with a first coupling aperture and being aligned along a central first port axis which is substantially perpendicular to the central common axis, said first coupling aperture configured to pass said first signal and cut off said second signal when said first port axis is perpendicular to the plane of polarization of said first signal;

a second port waveguide configured to carry said second signal, said second port waveguide being coupled to said common waveguide above said shorting point with a second coupling aperture and being aligned along a central second port axis which is substantially perpendicular to the central common axis and offset from said first port axis by substantially said predetermined angle, said second coupling aperture configured to pass said second signal and cut off said first signal when said second port axis is perpendicular to the plane of polarization of said second signal; and said shorting point being approximately an odd number of quarters of said first wavelength from the vertical midpoint of said first port waveguide at said first aperture;

wherein said first wavelength is substantially longer than said second wavelength, said common waveguide further comprising one or more ridges at said shorting point and aligned with said second port, said ridges configured to provide a virtual shorting point for said second signal at approximately an odd number of quarters of said second wavelength from the vertical midpoint of said second port waveguide at said second aperture.

2. The transducer of claim 1, further comprising:

a third port waveguide configured to carry said second signal and coupled to said common waveguide above said shorting point with a third coupling aperture;

said third port waveguide opposing said second port waveguide and being centrally aligned along said second port axis, said third coupling aperture configured to pass said second signal and cut off said first signal when said second port axis is perpendicular to the plane of polarization of said second signal; and an impedance divider connected to said second port waveguide by a first intermediate waveguide having a first length and to said third port waveguide by a second intermediate waveguide having a second length, said first and second lengths differing by substantially an odd number of halves of said second wavelength.

3. The ortho-mode transducer of claim 1 wherein:

said common waveguide, first port waveguide and second port waveguide each being comprised of a respective upper and lower portion;

a first block having the upper portions of said common waveguide, first port waveguide, and second port waveguide formed therein;

a second block having the lower portions of said common waveguide, first port waveguide, and second port waveguide formed therein;

said first block adjacent said second block and positioned such that said upper portions are substantially aligned with said lower portions.

4. The transducer of claim 1, wherein said predetermined angle is substantially 90 degrees.

5. A transducer comprising:

a first and second generally planar blocks;

a common waveguide having an upper portion formed in said first block and a lower portion formed in said second block;

said common waveguide aligned along a central common axis substantially perpendicular to said first and second blocks and configured to carry a first polarized signal having a first wavelength and a second polarized signal having a second wavelength, said first and second signals having polarity vectors differing by a predetermined angle, said common waveguide having a shorting point formed in said second block;

a first port waveguide having an upper portion formed in said first block and a lower portion formed in said second block;

said first port waveguide configured to carry said first signal and being coupled to said common waveguide above said shorting point at a first coupling aperture and aligned along a central first port axis which is substantially perpendicular to the central common axis;

said first coupling aperture having an upper portion formed in said first block and a lower portion formed in said second block and configured to pass said first signal and cut off said second signal when said first port axis is perpendicular to the plane of polarization of said first signal;

a second port waveguide having an upper portion formed in said first block and a lower portion formed in said second block;

said second port waveguide configured to carry said second signal and being coupled to said common waveguide above said shorting point with a second coupling aperture and being aligned along a central second port axis which is substantially perpendicular to the central common axis and offset from said first port axis by substantially said predetermined angle;

said second coupling aperture having an upper portion formed in said first block and a lower portion formed in said second block and configured to pass said second signal and cut off said first signal when said second port axis is perpendicular to the plane of polarization of said second signal; and said shorting point being approximately an odd number of quarters of said first wavelength from the vertical midpoint of said first port waveguide at said first aperture.

6. The transducer of claim 5, further comprising at least one of a filter section, receiver section, and transmitter section formed in said first and second blocks and being in electrical communication with said first waveguide port.

7. The transducer of claim 5, wherein said upper portion of said common waveguide extends through said first block and terminates in a coupler suitable for receiving a feed horn.

8. The transducer of claim 5, further comprising:

a third port waveguide having an upper portion formed in said first block and a lower portion formed in said second block;

said third port waveguide configured to carry said second signal and coupled to said common waveguide above said shorting point with a third coupling aperture, said third port waveguide opposing said second port waveguide and being centrally aligned along said second port axis;

said third coupling aperture having an upper portion formed in said first block and a lower portion formed in said second block and configured to pass said second signal and cut off said first signal when said second port axis is perpendicular to the plane of polarization of said second signal; and an impedance divider connected to said second port waveguide by a first intermediate waveguide having a first length and to said third port waveguide by a second intermediate waveguide having a second length, said first and second lengths differing by substantially an odd number of halves of said second wavelength.

9. An ortho-mode transducer comprising:

a common waveguide aligned along a central common axis and configured to carry a first polarized signal having a first wavelength and a second polarized signal having a second wavelength, said first and second signals having polarity vectors differing by a predetermined angle, said common waveguide having a shorting point;

a first port waveguide configured to carry said first signal, said first port waveguide being coupled to said common waveguide above said shorting point with a first coupling aperture and being aligned along a central first port axis which is substantially perpendicular to the central common axis, said first coupling aperture configured to pass said first signal and cut off said second signal when said first port axis is perpendicular to the plane of polarization of said first signal;

a second port waveguide configured to carry said second signal, said second port waveguide being coupled to said common waveguide above said shorting point with a second coupling aperture and being aligned along a central second port axis which is substantially perpendicular to the central common axis and offset from said first port axis by substantially said predetermined angle, said second coupling aperture configured to pass said second signal and cut off said first signal when said second port axis is perpendicular to the plane of polarization of said second signal;

a third port waveguide configured to carry said second signal and coupled to said common waveguide above said shorting point with a third coupling aperture;

said third port waveguide opposing said second port waveguide and being centrally aligned along said second port axis, said third coupling aperture configured to pass said second signal and cut off said first signal when said second port axis is perpendicular to the plane of polarization of said second signal; and an impedance divider connected to said second port waveguide by a first intermediate waveguide having a first length and to said third port waveguide by a second intermediate waveguide having a second length, said first and second lengths differing by substantially an odd number of halves of said second wavelength;

said shorting point being approximately an odd number of quarters of said first wavelength from the vertical midpoint of said first port waveguide at said first aperture.

10. The transducer of claim 9, wherein said predetermined angle is substantially 90 degrees.

11. The ortho-mode transducer of claim 9 wherein:

said common waveguide, first port waveguide and second port waveguide each being comprised of a respective upper and lower portion;

a first block having the upper portions of said common waveguide, first port waveguide, and second port waveguide formed therein;

a second block having the lower portions of said common waveguide, first port waveguide, and second port waveguide formed therein;

said first block adjacent said second block and positioned such that said upper portions are substantially aligned with said lower portions.

12. The transducer of claim 9, wherein:

said first and second wavelengths are substantially the same;

said shorting point being approximately an odd number of quarters of said second wavelength from the vertical midpoint of said second port waveguide at said second aperture.

13. The transducer of claim 9, wherein said first wavelength is substantially longer than said second wavelength, said common waveguide further comprising one or more ridges at said shorting point and aligned with said second port, said ridges configured to provide a virtual shorting point for said second signal at approximately an odd number of quarters of said second wavelength from the vertical midpoint of said second port waveguide at said second aperture.

14. An ortho-mode transducer comprising:

a common waveguide aligned along a central common axis and configured to carry a first polarized signal having a first wavelength and a second polarized signal having a second wavelength, said first and second signals having polarity vectors differing by a predetermined angle, said common waveguide having a shorting point;

a first port waveguide configured to carry said first signal, said first port waveguide being coupled to said common waveguide above said shorting point with a first coupling aperture and being aligned along a central first port axis which is substantially perpendicular to the central common axis, said first coupling aperture configured to pass said first signal and cut off said second signal when said first port axis is perpendicular to the plane of polarization of said first signal;

a second port waveguide configured to carry said second signal, said second port waveguide being coupled to said common waveguide above said shorting point with a second coupling aperture and being aligned along a central second port axis which is substantially perpendicular to the central common axis and offset from said first port axis by substantially said predetermined angle, said second coupling aperture configured to pass said second signal and cut off said first signal when said second port axis is perpendicular to the plane of polarization of said second signal;

said shorting point being approximately an odd number of quarters of said first wavelength from the vertical midpoint of said first port waveguide at said first aperture;

said common waveguide, first port waveguide and second port waveguide each being comprised of a respective upper and lower portion;

a first block having the upper portions of said common waveguide, first port waveguide and second port waveguide formed therein;

a second block having the lower portions of said common waveguide, first port waveguide, and second port waveguide formed therein;

said first block adjacent said second block and positioned such that said upper portions are substantially aligned with said lower portions.

15. The transducer of claim 14, wherein said predetermined angle is substantially 90 degrees.

16. The transducer of claim 14, further comprising:

a third port waveguide configured to carry said second signal and coupled to said common waveguide above said shorting point with a third coupling aperture;

said third port waveguide opposing said second port waveguide and being centrally aligned along said second port axis, said third coupling aperture configured to pass said second signal and cut off said first signal when said second port axis is perpendicular to the plane of polarization of said second signal; and an impedance divider connected to said second port waveguide by a first intermediate waveguide having a first length and to said third port waveguide by a second intermediate waveguide having a second length, said first and second lengths differing by substantially an odd number of halves of said second wavelength.

17. The transducer of claim 14, wherein:

said first and second wavelengths are substantially the same;

said shorting point being approximately an odd number of quarters of said second wavelength from the vertical midpoint of said second port waveguide at said second aperture.

18. The transducer of claim 14, wherein said first wavelength is substantially longer than said second wavelength, said common waveguide further comprising one or more ridges at said shorting point and aligned with said second port, said ridges configured to provide a virtual shorting point for said second signal at approximately an odd number of quarters of said second wavelength from the vertical midpoint of said second port waveguide at said second aperture.

* * * * *

UNITED STATES PATENT AND TRADEMARK OFFICE

CERTIFICATE OF CORRECTION

PATENT NO. : 6,087,908

DATED : July 11, 2000

INVENTOR(S) : Nicolas Haller and Scott J. Cook

It is certified that error appears in the above-identified patent and that said Letters Patent is hereby corrected as shown below:

On the title page, [75] Inventors, change "Evergreen, Colo." to --Middletown, N.J.--.

On the title page, [73] Assignee, change 'Smithfied, N.C." to --Smithfield, N.C.--.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*